US006875941B2

(12) United States Patent
Kawamoto et al.

(10) Patent No.: US 6,875,941 B2
(45) Date of Patent: Apr. 5, 2005

(54) HYDRAULIC OPERATING APPARATUS FOR SWITCH

(75) Inventors: Hideo Kawamoto, Hitachi (JP); Daisuke Ebisawa, Hitachi (JP); Kenichi Okubo, Hitachi (JP)

(73) Assignee: Japan AE Power Systems Corporation, Tokyo (JP)

( * ) Notice: Subject to any disclaimer, the term of this patent is extended or adjusted under 35 U.S.C. 154(b) by 0 days.

(21) Appl. No.: 10/747,268

(22) Filed: Dec. 30, 2003

(65) Prior Publication Data

US 2005/0006349 A1 Jan. 13, 2005

(30) Foreign Application Priority Data

Jan. 10, 2003 (JP) ..... 2003-003859

(51) Int. Cl.[7] ..... H01H 35/38
(52) U.S. Cl. ..... 218/92; 200/82 B
(58) Field of Search ..... 218/92, 84, 91–116, 218/140, 153, 154, 7, 14, 43, 51, 56, 66, 78, 86, 88; 91/451, 452, 517, 518; 200/82 B

(56) References Cited

U.S. PATENT DOCUMENTS 4,785,712 A * 11/1988 Yoshizumi et al. ..... 200/82 B
5,353,594 A * 10/1994 Yamashita et al. ..... 91/518
5,750,950 A * 5/1998 Nogami et al. ..... 218/154
5,804,787 A * 9/1998 Daimon et al. ..... 218/84

FOREIGN PATENT DOCUMENTS

| | | |
|---|---|---|
| JP | 5-298968 | 11/1993 |
| JP | 7-37801 | 2/1995 |
| JP | 9-92097 | 4/1997 |

* cited by examiner

*Primary Examiner*—Lincoln Donovan
*Assistant Examiner*—M. Fishman
(74) *Attorney, Agent, or Firm*—Mattingly, Stanger, Malur & Brundidge, P.C.

(57) ABSTRACT

Disclosed is a hydraulic operating apparatus for switch with which it is possible to constantly obtain a stable interrupting performance at the time of high-speed successive operations. Closing and interrupting pressure accumulators comprise closing and interrupting pressure accumulation pistons, and closing and interrupting pressure accumulation springs for biasing the closing and interrupting pressure accumulation pistons in pressure accumulation directions, respectively. The closing and interrupting pressure accumulation springs exert, on the closing and interrupting pressure accumulation pistons, forces corresponding to received pressures acting on the closing and interrupting pressure accumulation pistons from closing and interrupting pressure accumulation chambers in a steady state. The closing pressure accumulator and the interrupting pressure accumulator are independently constituted for closing and for interrupting, respectively.

4 Claims, 6 Drawing Sheets

HYDRAULIC OPERATING APPARATUS FOR SWITCH

BACKGROUND OF THE INVENTION

The present invention relates to a hydraulic operating apparatus for a switch for switching (interrupting and closing) a circuit breaker.

Generally, in a switch such as a gas-insulated switch comprising a circuit breaker, an operator for driving a movable contact element constituting the circuit breaker is provided. The main components of the operator are: a hydraulic operating apparatus which comprises a pressure accumulator using a compressed gas such as $N_2$ and in which a hydraulic fluid pressurized by the pressure accumulator acts on a piston to perform a switching operation: a pneumatic operating apparatus in which compressed air compressed in a pressure vessel by a compressor acts on a piston to perform a switching operation; and a spring operating apparatus in which a recoil force of a coil spring or belleville spring in an energy accumulating state acts to perform a switching operation. Among these operating apparatuses, the hydraulic operating apparatus is superior to the other operating apparatuses in view of its high-speed operation, small size, low noise, high output and the like but has such demerits as high cost, fluid leakage, and a large number of accessories. In the hydraulic operating apparatus, particularly, the pressure accumulator constituting a drive source has a structure in which the compressed gas acts on one surface of a pressure accumulation piston provided with a piston seal to thereby compress the hydraulic fluid, and, therefore, has a seal structure in which the hydraulic fluid and the compressed gas at an equal pressure are sealed gas-tight by a single seal at the piston seal portion. Due to the use of the compressed gas, this kind of pressure accumulator has the problem that the gas is contracted and expanded attendant on variations in the ambient temperature, with the result of variations in the pressure of the hydraulic fluid also. In contrast to this, there has been known a hydraulic operating apparatus in which a belleville spring is used in place of the pressure accumulation piston provided with the piston seal in the pressure accumulator so as to obviate the problem of variations in the pressure of the hydraulic fluid due to the variations in the ambient temperature (see, for example, Japanese Patent Laid-open Nos. 5-298968, 7-37801, 9-92097).

However, when the pressure accumulator in each of the conventional hydraulic operating apparatuses for switch performs high-speed successive operations (O—0.3 sec—CO—1 min—CO, CO—15 sec—CO, or the like) which are the required operations of the circuit breaker, the high-pressure hydraulic fluid in the pressure accumulator is consumed according to the operation and, simultaneously, the belleville spring having been compressed gradually releases the accumulated energy. Therefore, a difference in accumulated pressure is generated in the high-pressure hydraulic fluid between the first interrupting (cutoff) operation and the second interrupting operation, resulting in dispersion of the interrupting performance. In order to avoid this problem, it may be contemplated to enlarge the pressure accumulator in size so as to restrain the pressure variation of the high-pressure hydraulic fluid due to the successive interrupting operations, but this approach would enlarge the hydraulic operating apparatus for switch. For the hydraulic operating apparatus for switch, generally, a normal-time pressure variation range, a high-speed re-closing (O-0.3 sec-CO-1 min- CO) operation lock pressure, a closing (turning-ON) operation lock pressure, and an interrupting operation lock pressure are specified, based on the rated pressure. This makes it necessary to ensure the circuit interrupting performance of the apparatus for each of the operation lock pressures. In addition, the mechanical strength of the apparatus must be designed for the maximum value in the normal-time pressure range. As a result, there is a difference of not less than 130% between the minimum pressure for ensuring the circuit interrupting performance and the maximum pressure for ensuring the mechanical performance. Accordingly, a very uneconomical designing has been required.

SUMMARY OF THE INVENTION

It is an object of the present invention to provide a hydraulic operating apparatus for switch with which it is possible to constantly obtain a stable interrupting performance at the time of high-speed successive operations.

In order to attain the above object, according to the present invention, there is provided a hydraulic operating apparatus for switch, comprising an operating piston connected to a movable contact element of a circuit breaker, a main control valve for controlling high-pressure hydraulic fluids acting on both surfaces of the operating piston to thereby switching the circuit breaker through the operating piston, and a pressure accumulator for exerting accumulated pressures on the high-pressure hydraulic oils, wherein the pressure accumulator comprises a closing pressure accumulator and an interrupting pressure accumulator provided independently from each other, and the closing pressure accumulator and the interrupting pressure accumulator comprise a closing pressure accumulation chamber and an interrupting pressure accumulation chamber into which the high-pressure hydraulic fluids acting on both surfaces of the operating piston are introduced respectively, a closing pressure accumulation piston and an interrupting pressure accumulation piston disposed respectively in the closing pressure accumulation chamber and the interrupting pressure accumulation chamber, and a closing accumulated pressure exerting means and an interrupting accumulated pressure exerting means for exerting the accumulated pressures respectively on the high-pressure hydraulic fluids introduced into the closing pressure accumulation chamber and the interrupting pressure accumulation chamber through the closing pressure accumulation piston and the interrupting pressure accumulation piston.

In the hydraulic operating apparatus for switch according to the present invention, the closing pressure accumulator and the interrupting pressure accumulator are provided independently from each other, and the closing pressure accumulator and the interrupting pressure accumulator comprise the closing pressure accumulation chamber and the interrupting pressure accumulation chamber into which the high-pressure hydraulic fluids acting on both surfaces of the operating piston are introduced respectively, the closing pressure accumulation piston and the interrupting pressure accumulation piston disposed respectively in the closing pressure accumulation chamber and the interrupting pressure accumulation chamber, and the closing accumulated pressure exerting means and the interrupting accumulated pressure exerting means for exerting the accumulated pressures respectively on the high-pressure hydraulic fluids introduced into the closing pressure accumulation chamber and the interrupting pressure accumulation chamber through the closing pressure accumulation piston and the interrupting pressure accumulation piston. Therefore, even when the high-pressure hydraulic fluids in the closing pressure accumulation chamber and the interrupting pressure accumulation chamber are varied, the accumulated pressures can be exerted respectively on the high-pressure hydraulic fluids introduced into the closing pressure accumulation chamber and the interrupting pressure accumulation chamber, by the closing accumulated pressure exerting means and the interrupting accumulated pressure exerting means. Besides, even in the case of high-speed operations for repeating closing and interrupting, it is possible to set the initial operating pressure at a substantially equal value and to constantly obtain a stable operating performance, and it is possible to reduce the size of the pressure accumulator for thereby making the most of the characteristic features of the hydraulic system.

In addition, in the above hydraulic operating apparatus for switch, springs may be used respectively as the closing accumulated pressure exerting means and the interrupting accumulated pressure exerting means. In this case, it is possible to set the initial operating pressure at a substantially equal value and to constantly obtain a stable operating performance, while precluding the influences of the ambient temperature.

Besides, in the above hydraulic operating apparatus for switch, a combination of a spring and a compressed gas acting on each of the closing pressure accumulation piston and the interrupting pressure accumulation piston in the same direction is used as each of the closing accumulated pressure exerting means and the interrupting accumulated pressure exerting means. In this case, the pressure of the compressed gas can be lowered by the pressure in charge of the spring. Besides, it is possible to set the initial operating pressure at a substantially equal value and to constantly obtain a stable operating performance, while preventing the compressed gases from passing to the sides of the closing pressure accumulation chamber and the interrupting pressure accumulation chamber as in the prior art, and it is possible to reduce the size of the pressure accumulator for thereby making the most of the characteristic features of the hydraulic system.

Furthermore, in the above hydraulic operating apparatus for switch, the high-pressure hydraulic fluid normally acts on one surface of the operating piston, whereas the high-pressure hydraulic fluid controlled by the main control valve acts on the other surface of the operating piston, and the one surface side of the operating piston is communicated to the interrupting pressure accumulation chamber of the interrupting pressure accumulator. In this case, it is possible to energize the spring as the interrupting accumulated pressure exerting means by the high-pressure hydraulic fluid acting on the operating piston from the closing pressure accumulation chamber at the time of a closing operation, and to exerted the accumulated pressure on the high-pressure hydraulic fluid in the interrupting pressure accumulation chamber by the spring through the interrupting pressure accumulation piston. As a result, it is possible to swiftly prepare for an interrupting operation.

BRIEF DESCRIPTION OF THE DRAWINGS

The above and other objects, features and advantages of the present invention will become apparent from the following description and appended claims, taken in conjunction with the accompanying drawings, wherein:

DETAILED DESCRIPTION OF THE PREFERRED EMBODIMENTS

Figure 1:
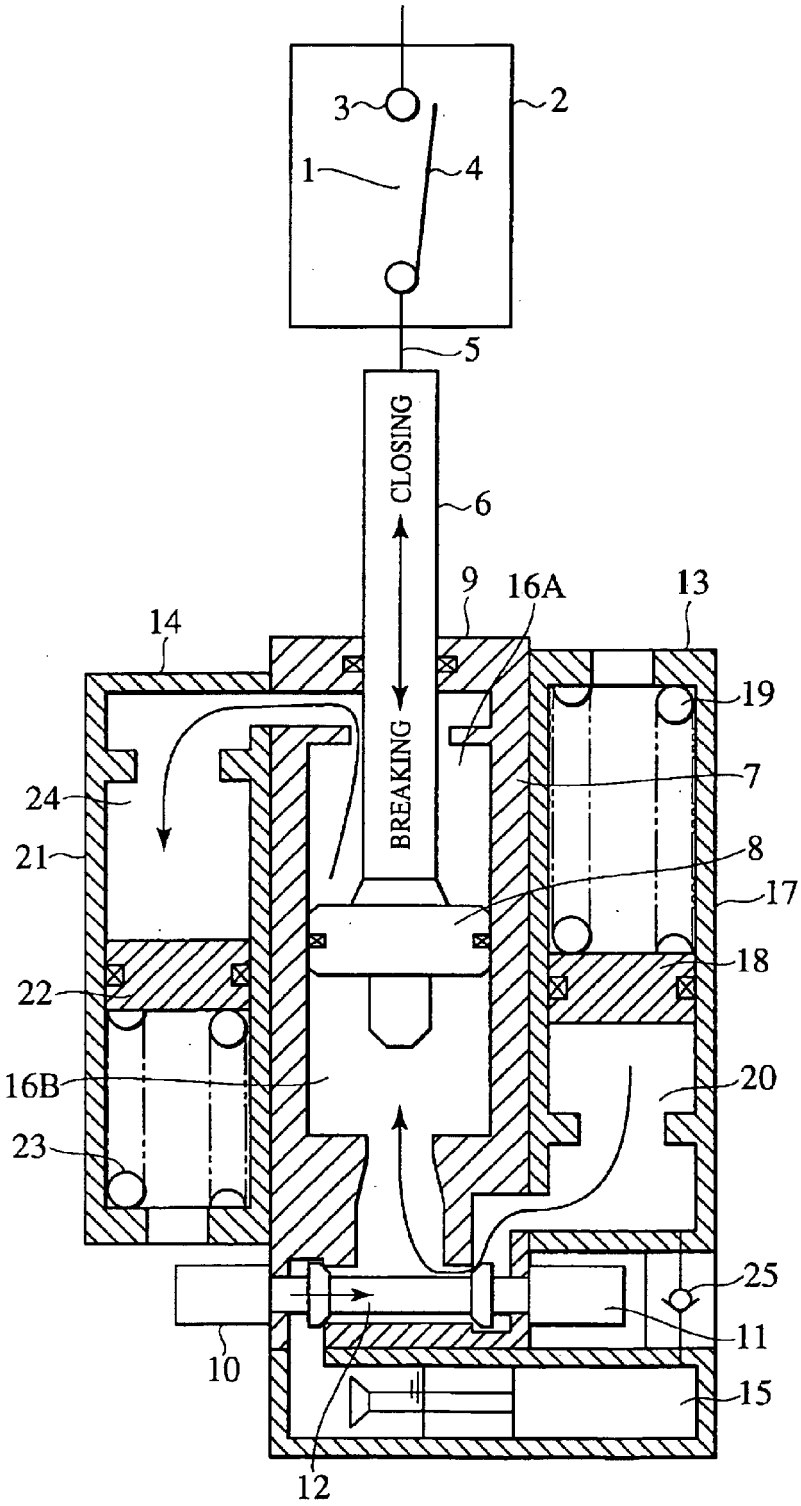
FIG. 1 is a sectional view of a hydraulic operating apparatus for switch according to one embodiment of the present invention.

Now, some embodiments of the present invention will be described below, referring to the drawings.

FIG. 1 is a sectional view of a hydraulic operating apparatus for switch according to one embodiment of the present invention.

A circuit breaker 1 is constituted in a ground tank 2 filled with a gas excellent in insulation characteristic, and comprises a fixed contact element 3 and a movable contact element 4 operated to make contact with and part from the fixed contact element 3. The movable contact element 4 is connected to an output shaft 6 of the hydraulic operating apparatus for switch through an insulating operating rod 5 or the like. With the output shaft 6 driven to move downwards in the figure, a braking operation of the circuit breaker 1 is performed, and with the output shaft 6 driven to move upwards in the figure, a closing operation of the circuit breaker 1 is performed.

The hydraulic operating apparatus for switch is comprised of a main drive unit 9 consisting basically of a cylinder 7- and an operating piston 8, a main control valve 12 comprising a closing pilot valve 10 and an interrupting pilot valve 11 for giving operating commands to the main drive unit 9, a closing pressure accumulator 13 and an interrupting pressure accumulator 14 for exerting accumulated pressures on high-pressure hydraulic fluids, and a hydraulic pump unit 15. The operating piston 8 constituting the main drive unit 9 is slidably disposed in the cylinder 7, and is connected to the output shaft 6, which is led to the exterior of the cylinder 7. Therefore, hydraulic chambers 16A and 16B in which the high-pressure hydraulic fluids act respectively on both surfaces of the operating piston 8 are formed in the cylinder 7, and the pressure exerted on the operating piston 8 by the high-pressure hydraulic fluid on the side of the hydraulic chamber 16B is greater than the pressure on the other side by a value corresponding to the sectional area of the output shaft 6.

The main control valve 12 for controlling the high-pressure hydraulic fluid in the hydraulic chamber 16B is so constructed that when the closing pilot valve 10 is supplied with a closing command and the valve element is driven rightwards, the high-pressure hydraulic fluid is supplied into the hydraulic chamber 16B to give an upward closing operating force to the operating piston 8, and when the interrupting pilot valve 11 is supplied with an interrupting command and the valve element is driven leftwards, the high-pressure hydraulic fluid in the hydraulic chamber 16B is discharged to give a downward interrupting operating force to the operating piston 8.

The closing pressure accumulator 13 comprises a closing pressure accumulation piston 18 slidably disposed in a cylinder 17 and a closing pressure accumulation spring 19 disposed in the cylinder 17, and the closing pressure accumulation piston 18 is biased (energized) by the closing pressure accumulation spring 19, whereby an accumulated pressure is given to the high-pressure hydraulic fluid in a closing pressure accumulation chamber 20 communicated with the hydraulic chamber 16B. The closing pressure accumulation spring 19 has a spring force so set as to exert on the closing pressure accumulation piston 18 a force corresponding to the pressure exerted on the closing pressure accumulation piston 18 from the closing pressure accumulation chamber 20 in a steady state.

On the other hand, the interrupting pressure accumulator 14 comprises an interrupting pressure accumulation piston 22 slidably disposed in a cylinder 21 and an interrupting pressure accumulation spring 23 disposed in the cylinder 21, and the interrupting pressure accumulation piston 22 is biased by the interrupting pressure accumulation spring 23, whereby an accumulated pressure is given to the high-pressure hydraulic fluid in an interrupting pressure accumulation chamber 24 communicated with the hydraulic chamber 16A. The interrupting pressure accumulation spring 23 also has a spring force so set as to exert on the interrupting pressure accumulation piston 22 a force corresponding to the pressure exerted on the interrupting pressure accumulation piston 22 from the interrupting pressure accumulation chamber 24 in a steady state. The closing pressure accumulator 13 and the interrupting pressure accumulator 14 are not integrally constituted so as to be usable in common but independently constituted for closing and for interrupting, respectively.

As accessories for driving the hydraulic operating apparatus for switch, there are provided a check valve 25 disposed in a hydraulic circuit for supplying the high-pressure hydraulic fluid from the hydraulic pump unit 15 into the closing pressure accumulation chamber 20, and a lock mechanism (not shown) for mechanically locking the operating piston 8 to prevent the operating piston 8 from being moved when the operating pressure is released at the time of inspection or the like or when the pressure is suddenly lowered due to a trouble.

Next, the operations of the above-described hydraulic operating apparatus for switch will be described.

Figure 2:
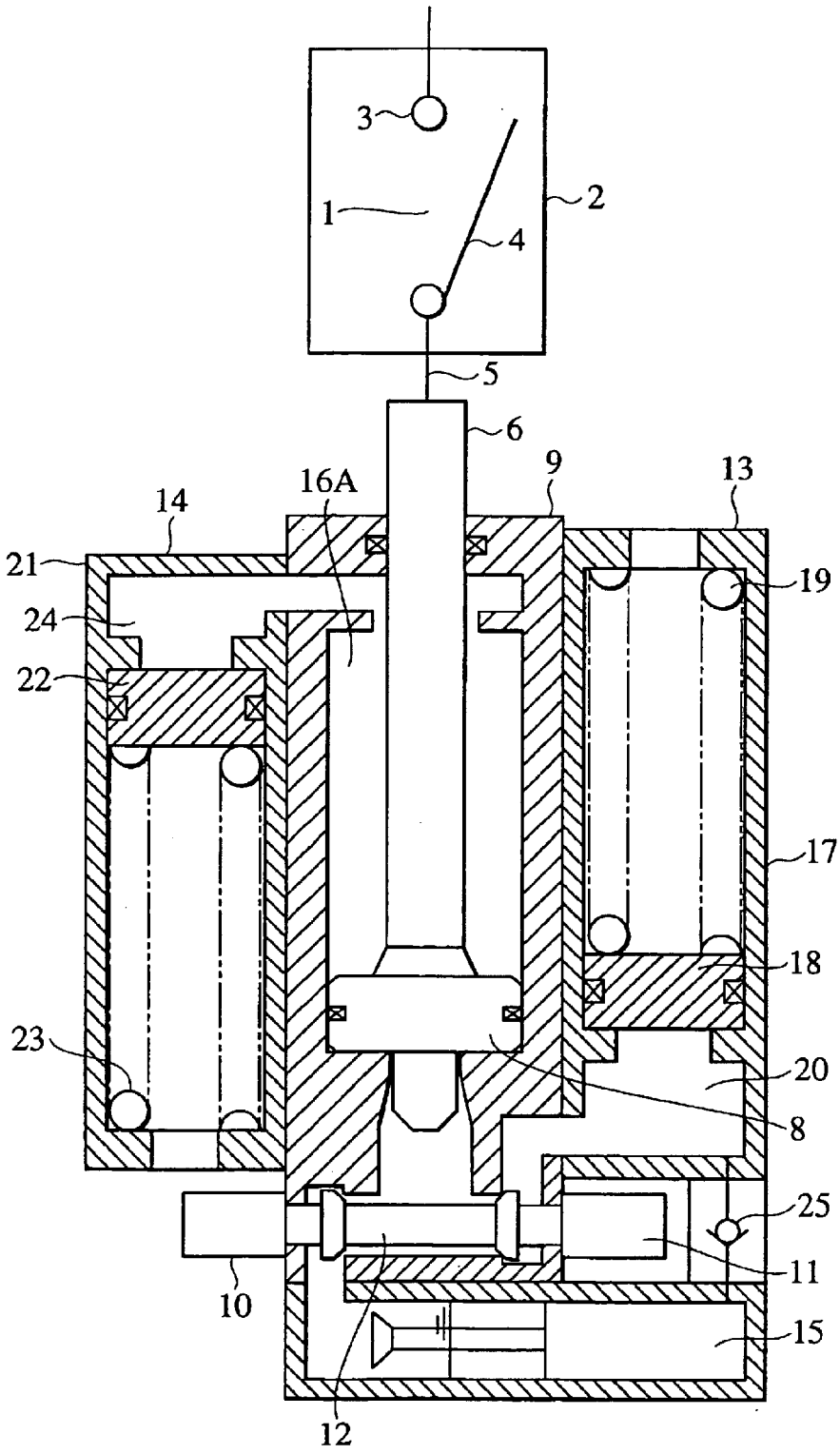
FIG. 2 is a sectional view showing an initial state of an interrupting operation of the hydraulic operating apparatus for switch shown in FIG. 1.
Figure 3:
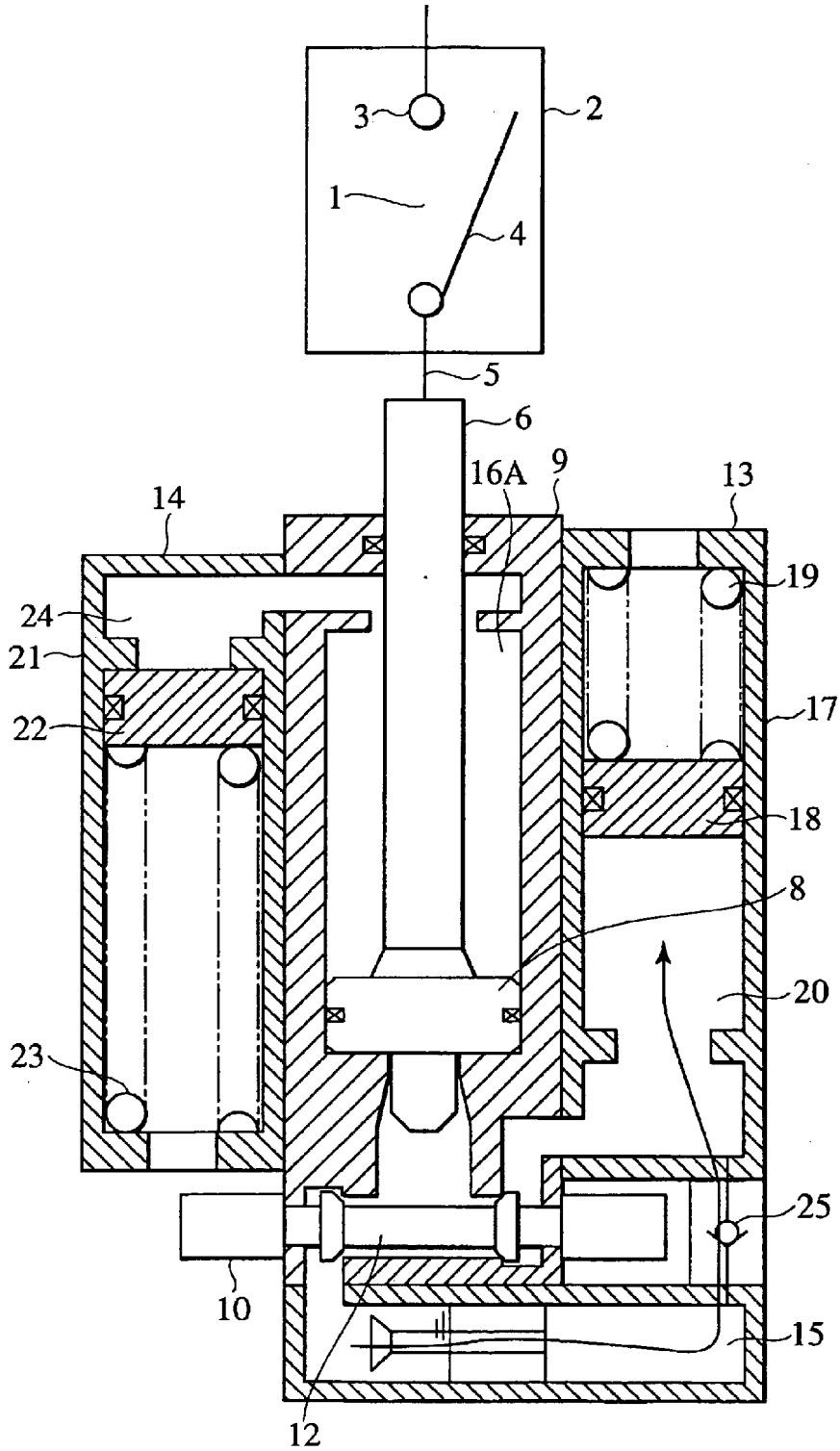
FIG. 3 is a sectional view showing a final state of the interrupting operation of the hydraulic operating apparatus for switch shown in FIG. 1.

FIG. 2 shows an initial state of an interrupt condition of the circuit breaker 1. In this instance, the hydraulic chamber 16B is communicated to the side of the hydraulic pump unit 15 by the valve element of the main control valve 12, and the hydraulic fluid has been recovered to the side of the hydraulic pump unit 15. Therefore, the operating piston 8 is driven in the downward interrupting direction and maintained in the lowered condition by the pressure exerted thereon from the side of the hydraulic chamber 16A. In this instance, the interrupting pressure accumulation spring 23 in the interrupting pressure accumulator 14 is in a spring force released condition, and the closing pressure accumulation spring 19 in the closing pressure accumulator 13 is in a spring force released condition. Subsequently, the hydraulic pump unit 15 operates as shown in FIG. 3, whereby the high-pressure hydraulic fluid is supplied through the check valve 25 into the closing pressure accumulation chamber 20 as indicated by an arrow, so that the closing pressure accumulation spring 19 is compressed to a predetermined displacement while the closing pressure accumulation piston 18 is driven upwards, and the high-pressure hydraulic fluid is held by the check valve 25. The hydraulic pump unit 15 undergoes an ON/OFF control through a contact (not shown) mechanically connected to the closing pressure accumulation piston 18.

Figure 4:
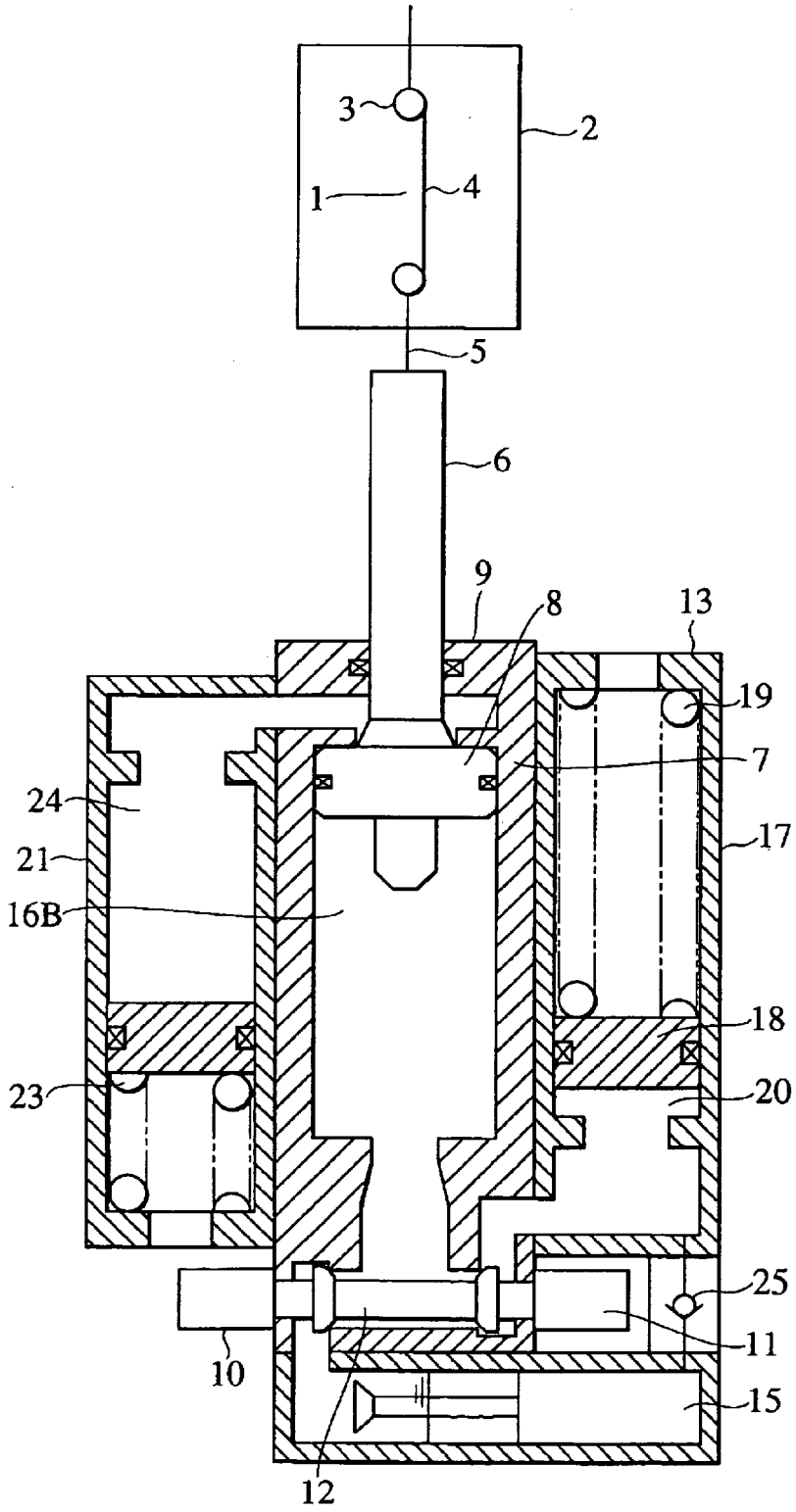
FIG. 4 is a sectional view showing an initial state of a closing operation of the hydraulic operating apparatus for switch shown in FIG. 1.

When a closing command is input to the closing pilot valve 10 under this condition, the valve element of the main control valve 12 is driven rightwards as shown in FIG. 4, whereby the communication between the hydraulic chamber 16B and the side of the hydraulic pump unit 15 is interrupted, whereas the closing pressure accumulation chamber 20 of the closing pressure accumulator 13 and the hydraulic chamber 16B are communicated with each other. Therefore, the high-pressure hydraulic fluid from the closing pressure accumulation chamber 20 of the closing pressure accumulator 13 acts on the operating piston 8, and a received pressure due to the difference in pressure-receiving area drives the operating piston 8 in an upward closing direction in the figure, whereby the circuit breaker 1 is put into a closed condition. By the movement of the operating piston 8 in this instance, the high-pressure hydraulic fluid in the hydraulic chamber 16A flows into the interrupting pressure accumulation chamber 24 of the interrupting pressure accumulator 14 to displace the interrupting pressure accumulation piston 22, thereby compressing the interrupting pressure accumulation spring 23.

Figure 5:
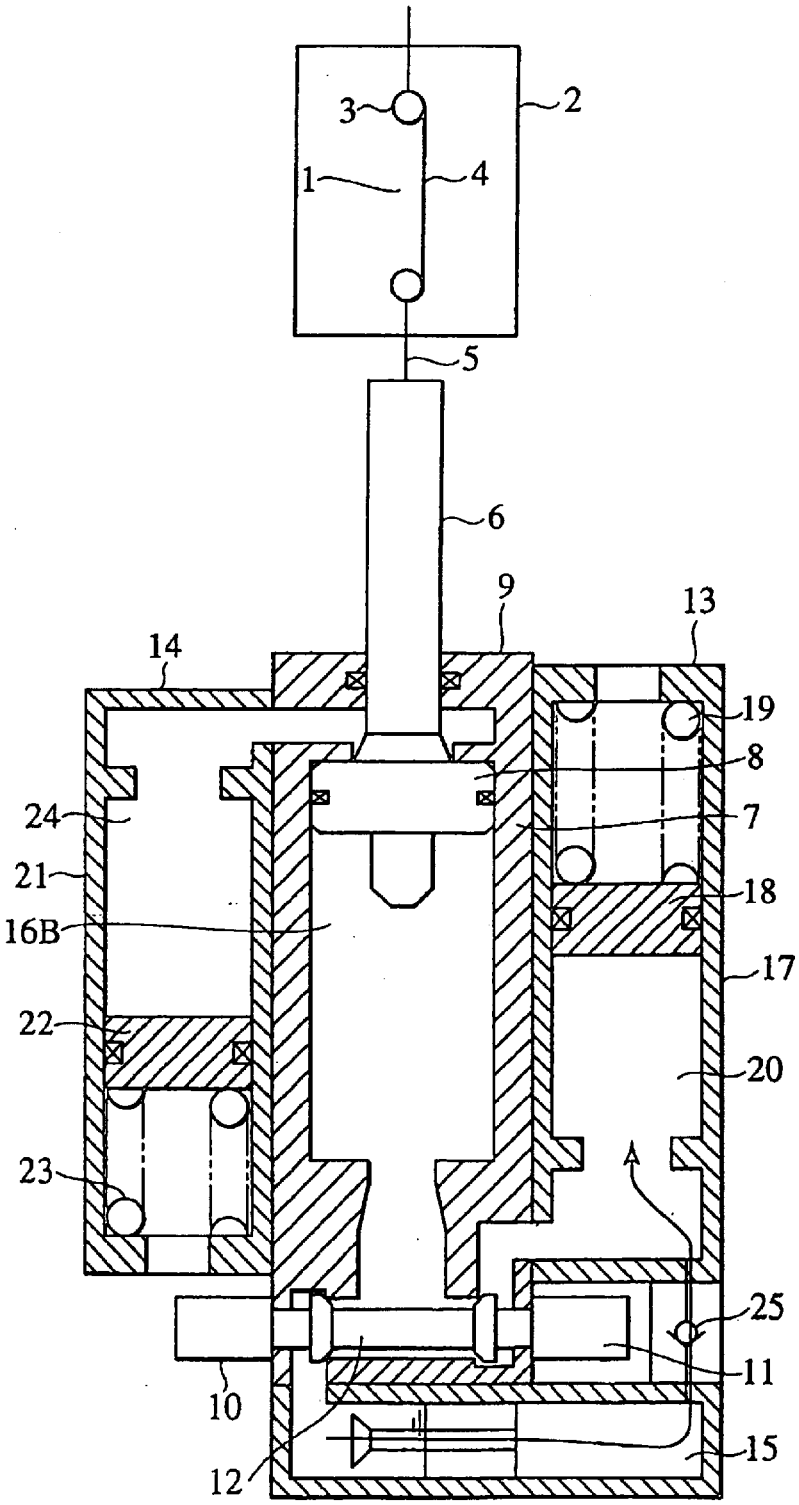
FIG. 5 is a sectional view showing a final state of the closing operation of the hydraulic operating apparatus for switch shown in FIG. 1.

When this closed condition is established, the hydraulic pump unit 15 is again operated, whereby the high-pressure hydraulic fluid is supplied through the check valve 25 into the closing pressure accumulation chamber 20 of the closing pressure accumulator 13 as indicated by an arrow in FIG. 5, to compress the closing pressure accumulation spring 19 while driving the closing pressure accumulation piston 18 upwards in the figure.

Figure 6:
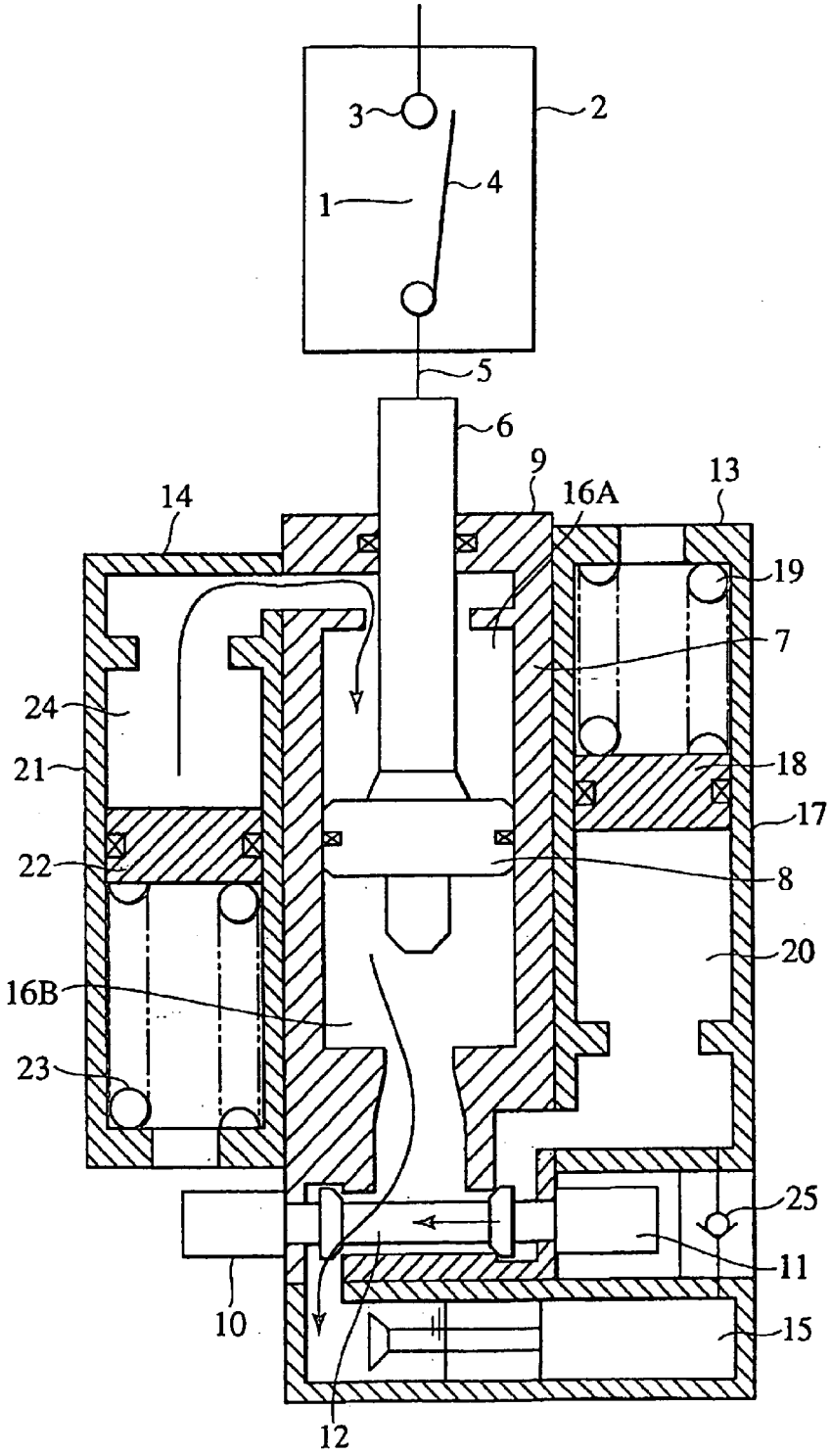
FIG. 6 is a sectional view showing an intermediate state of an interrupting operation of the hydraulic operating apparatus for switch shown in FIG. 1

In the case where a trouble in a main circuit is not yet recovered when the closing of the circuit breaker 1 is conducted, an interrupting command is again input to the interrupting pilot valve 11. Then, the valve element of the main control valve 12 is driven leftwards as indicated by an arrow in FIG. 6, whereby the hydraulic chamber 16B is discommunicated from the closing pressure accumulation chamber 20, and is communicated to the side of the hydraulic pump unit 15. Therefore, the high-pressure hydraulic fluid in the hydraulic chamber 16B is discharged to the side of the hydraulic pump unit 15 as indicated by an arrow, whereby the operating piston 8 is driven in the downward interrupting direction in the figure by a received pressure due to the difference in pressure-receiving area at both surfaces thereof, to put the circuit breaker 1 into an interrupt condition.

In a conventional hydraulic operating apparatus for switch, when the amount of the high-pressure hydraulic fluid in the hydraulic chamber 24 has been reduced due to the preceding operation, the pressure in the hydraulic chamber 24 at the start of the interrupting operation varies, whereby the interrupting operation characteristic is also varied. On the other hand, the interrupting pressure accumulation spring 23 in this embodiment has a spring force determined in correspondence with the received pressure exerted on the interrupting pressure accumulation piston 22 from the side of the interrupting pressure accumulation chamber 24 in a rated condition; therefore, even if the amount of the high-pressure hydraulic fluid in the hydraulic chamber 24 has been reduced as compared with that at the time of the preceding interrupting operation, the interrupting pressure accumulation spring 23 exerts on the interrupting pressure accumulation piston 22 a force in the direction of compressing the high-pressure hydraulic fluid in the hydraulic chamber 24. Accordingly, the high-pressure hydraulic fluid in the hydraulic chamber 24 has the same operation start pressure as that in the rated condition, resulting in that the same and stable interrupting performance can be constantly obtained.

In the case of a high-speed re-closing, a closing operation is performed 0.3 sec after the above interrupting operation. This closing operation is conducted in the manner as descried referring to FIGS. 3 and 4 above. If the amount of the high-pressure hydraulic fluid in the hydraulic chamber 20 has been reduced as a result of the precedent operation, in the conventional hydraulic operating apparatus for switch, the pressure of the high-pressure hydraulic fluid in the hydraulic chamber 20 at the start of the closing operation is different from the precedent one, so that the operating characteristic is also different. On the other hand, the closing pressure accumulation spring 19 in the hydraulic operating apparatus for switch in this embodiment has a spring force determined in correspondence with the received pressure exerted on the closing pressure accumulation piston 18 from the side of the closing pressure accumulation chamber 20 in the rated condition; therefore, even if the amount of the high-pressure hydraulic fluid in the hydraulic chamber 20 has been reduced as compared with that at the time of the preceding operation, the closing pressure accumulation spring 19 exerts on the closing pressure accumulation piston 18 a force in the direction of compressing the high-pressure hydraulic fluid in the hydraulic chamber 20. Accordingly, the high-pressure hydraulic fluid in the hydraulic chamber 20 has the same operation start pressure as that in the rated condition, so that a stable closing operation characteristic can be obtained.

Besides, according to the specifications for a circuit breaker, the above-mentioned high-speed re-closing operation must be followed, after 1 min. by a closing-interrupting operation again. In view of this, the hydraulic pump unit 15 is provided with such a pump capacity as to be able to compress the closing pressure accumulation spring 19 to a predetermined state during the 1-min period, whereby it is possible to cope with the high-speed operations.

In the hydraulic operating apparatus for switch in the above-described embodiment, the closing pressure accumulation spring 19 is used for exerting an accumulated pressure on the closing pressure accumulation piston 18 in the closing pressure accumulator 13, and the interrupting pressure accumulation spring 23 is used for exerting an accumulated pressure on the interrupting pressure accumulation piston 22 in the interrupting pressure accumulator 14. Each of the accumulated pressure exerting means constituted of the closing pressure accumulation spring 19 and the interrupting pressure accumulation spring 23 may be a coil spring or a belleville spring. In either case, since the closing pressure accumulator 13 and the interrupting pressure accumulator 14 are independently provided for closing and for interrupting, the pressure variations in the closing pressure accumulation chamber 20 and the interrupting pressure accumulation chamber 24 can be dispersed, so that the closing pressure accumulation spring 19 and the interrupting pressure accumulation spring 23 can be reduced in size, particularly as compared with the case where the two accumulators are designed for common use. Namely, where the two accumulators are designed for common use, the hydraulic portion is very small in size, whereas the spring portion is enlarged in size, resulting in that the merit of reducing the hydraulic operating apparatus in size is reduced by half.

In this embodiment, besides, the high-pressure hydraulic fluid normally acts in the hydraulic chamber 16A formed on one surface of the operating piston 8, whereas the high-pressure hydraulic fluid controlled by the main control valve 12 acts on the other surface of the operating piston 8, and the one surface side of the operating piston 8 is communicated with the interrupting pressure accumulation chamber 24 of the interrupting pressure accumulator 14. Therefore, it is possible to energize the interrupting pressure accumulation spring 23 by the high-pressure hydraulic fluid acting on the operating piston 8 from the closing pressure accumulation chamber 20 at the time of a closing operation, to exert an accumulated pressure on the high-pressure hydraulic fluid in the interrupting pressure accumulation chamber 24 by the energy-accumulated interrupting pressure accumulation spring 23 through the interrupting pressure accumulation piston 22, and to swiftly prepare for an interrupting operation.

In another embodiment of the present invention, the closing pressure accumulation spring 19 and the interrupting pressure accumulation spring 23 in the closing pressure accumulator 13 and the interrupting pressure accumulator 14 may be replaced with accumulated pressure exerting means using a compressed gas such as $N_2$ gas. In this case, with the closing pressure accumulator 13 and the interrupting pressure accumulator 14 independently provided for closing and for interrupting respectively, the pressure variations in the closing pressure accumulation chamber 20 and the interrupting pressure accumulation chamber 24 can be dispersed, whereby the closing pressure accumulator 13 and the interrupting pressure accumulator 14 can be reduced in size, particularly as compared to the case where they are designed for common use.

In a further embodiment of the present invention, the closing pressure accumulator 13 and the interrupting pressure accumulator 14 may be mixed accumulated pressure exerting means comprised of the closing pressure accumulation spring 19 and the interrupting pressure accumulation spring 23 in combination with compressed gases such as $N_2$ gas acting on the closing pressure accumulation piston 18 and the interrupting pressure accumulation piston 22 in the same directions as the closing pressure accumulation spring 19 and the interrupting pressure accumulation spring 23, respectively. In addition, the use of the closing pressure accumulation spring 19 and the interrupting pressure accumulation spring 23 reduces the accumulated pressures that must be exerted on the closing pressure accumulation piston 18 and the interrupting pressure accumulation piston 22 from the compressed gases, so that the pressures of the compressed gases can be lower than those required in the prior art. Therefore, it is possible to prevent the compressed gases from penetrating through a piston seal to the sides of the closing pressure accumulation chamber 20 and the interrupting pressure accumulation chamber 24.

However, the adoption of the accumulated pressure exerting means using only the closing pressure accumulation spring 19 and the interrupting pressure accumulation spring 23 shown in the figures as the closing pressure accumulator 13 and the interrupting pressure accumulator 14 has the following merit. In the conventional pressure accumulator as the drive source using only a compressed gas has the problem that the compressed gas contracts and expands attendant on variations in the ambient temperature, to cause variations in the hydraulic pressure, so that the pressure of the high-pressure hydraulic fluid at the time of starting an operation is varied, and the operating characteristic is also varied. The above adoption makes it possible to obviate this problem.

Incidentally, in the hydraulic operating apparatus for switch according to the present invention, the constitutions of the main drive unit 9 and the main control valve 12 in the above-described embodiment are not limited to those shown in the figures, and other known constitutions may be adopted.

As described above, according to the hydraulic operating apparatus for switch of the present invention, the closing pressure accumulator and the interrupting pressure accumulator are independently constituted for closing and for interrupting, respectively. Therefore, it is possible to reduce the size of the pressure accumulator for thereby making the most of the characteristic features of the hydraulic system, and to constantly obtain a stable interrupting performance at the time of high-speed successive operations.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A hydraulic operating apparatus for a switch, comprising:

an operating piston connected to a movable contact element of a circuit breaker;

a main control valve for controlling high-pressure hydraulic fluids acting on both surfaces of said operating piston to thereby switching said circuit breaker through said operating piston; and a pressure accumulator for exerting accumulated pressures on said high-pressure hydraulic fluids;

wherein said pressure accumulator comprises a closing pressure accumulator and an interrupting pressure accumulator provided independently from each other, and said closing pressure accumulator and said interrupting pressure accumulator comprise a closing pressure accumulation chamber and an interrupting pressure accumulation chamber into which said high-pressure hydraulic fluids acting on both surfaces of said operating piston are introduced respectively, a closing pressure accumulation piston and an interrupting pressure accumulation piston disposed respectively in said closing pressure accumulation chamber and said interrupting pressure accumulation chamber, and a closing accumulated pressure exerting means and an interrupting accumulated pressure exerting means for exerting the accumulated pressures respectively on said high-pressure hydraulic fluids introduced into said closing pressure accumulation chamber and said interrupting pressure accumulation chamber through said closing pressure accumulation piston and said interrupting pressure accumulation piston.

2. The hydraulic operating apparatus for a switch as set forth in claim 1, wherein springs are used respectively as said closing accumulated pressure exerting means and said interrupting accumulated pressure exerting means.

3. The hydraulic operating apparatus for a switch as set forth in claim 1, wherein a combination of a spring and a compressed gas acting on each of said closing pressure accumulation piston and said interrupting pressure accumulation piston in the same direction is used as each of said closing accumulated pressure exerting means and said interrupting accumulated pressure exerting means.

4. The hydraulic operating apparatus for a switch as set forth in claim 1, wherein said high-pressure hydraulic fluids normally act on one surface of said operating piston, whereas said high-pressure hydraulic fluids controlled by said main control valve act on the other surface of said operating piston, and said one surface side of said operating piston is communicated with said interrupting pressure accumulation chamber of said interrupting pressure accumulator.

* * * * *